US006273295B1

(12) United States Patent
Quartarone et al.

(10) Patent No.: US 6,273,295 B1
(45) **Date of Patent: *Aug. 14, 2001**

(54) WATER TANK AND PUMP SYSTEM

(75) Inventors: Daniel S. Quartarone, Stone Mountain; Ronald E. Grimm, Grayson; Gary V. Paisley, Alpharetta, all of GA (US); Christopher H. Verdugo, Yorba Linda, CA (US); Douglas P. Goulet, Big Lake, MN (US); Steven T. Jersey, Laguan Niguel, CA (US)

(73) Assignee: The Coca-Cola Company, Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/386,700

(22) Filed: Aug. 31, 1999

(51) Int. Cl.[7] ..... B67D 5/08
(52) U.S. Cl. ..... 222/67; 222/129.1; 222/318
(58) Field of Search ..... 222/67, 129.1, 222/146.6, 318

(56) References Cited

U.S. PATENT DOCUMENTS

| | | | | |
|---|---|---|---|---|
| 3,398,550 | | 8/1968 | Lents | 62/179 |
| 3,627,131 | * | 12/1971 | Goodman | 222/129.1 |
| 3,731,845 | * | 5/1973 | Booth | 222/67 |
| 5,068,116 | | 11/1991 | Gibney et al. | 426/231 |
| 5,190,189 | | 3/1993 | Zimmer et al. | 222/67 |
| 5,316,180 | * | 5/1994 | Cleland | 222/67 X |
| 6,015,486 | * | 1/2000 | Watanabe | 222/129.1 |

FOREIGN PATENT DOCUMENTS

| | | |
|---|---|---|
| 2178395 | 2/1987 | (GB) . |
| 2267891 | 12/1993 | (GB) . |

* cited by examiner

*Primary Examiner*—Kevin Shaver
*Assistant Examiner*—Thach H Bui
(74) *Attorney, Agent, or Firm*—Finnegan, Henderson, Farabow, Garrett & Dunner, L.L.P.

(57) ABSTRACT

A water system for a beverage dispenser connected to a conventional water source. The water system includes a water tank with a volume of water and a volume of air. The water tank is connected to the conventional water source. A pump is connected to water tank so as to provide the water to the beverage dispenser.

31 Claims, 3 Drawing Sheets

WATER TANK AND PUMP SYSTEM

RELATED APPLICATIONS

The following patent applications for related subject matter,

"Modular Beverage Dispenser Components"Ser. No. 09/387,131;

"Mounting Block For Syrup Pump And Accessories", Ser. No. 09/387,045 and

"Improved Cold Plate" Ser. No. 09/386,700;

all of which are incorporated herein by reference, have been filed concurrently with the present application by the assignee of the present application.

TECHNICAL FIELD

The present application relates generally to beverage dispenser systems, and more particularly relates to a water system having a water tank and a pump for providing consistent water flow and water pressure in a beverage dispenser.

BACKGROUND OF THE INVENTION

Beverage dispensers of various configurations are well known in the art. A beverage dispenser generally includes a series of syrup circuits and water circuits. The syrup circuits generally include an incoming syrup line, a syrup pump, and a series of syrup cooling coils. The syrup cooling coils are generally positioned within an ice water bath or a cold plate so as to cool the syrup to the appropriate temperature. The source of the syrup may be a bag-in-box, a figal, a syrup tank, or any other type of conventional syrup source. The water circuits generally include an incoming water line, a water pump, a carbonator, and a series of water cooling coils. The water cooling coils also are positioned within the ice water bath or the cold plate so as to chill the water. The source of the water is generally tap water or any other type of conventional water source. The carbonator adds carbon dioxide bubbles to the incoming water stream so as to produce soda water. The syrup circuits and the water circuits are then joined at a dispensing valve for mixing. The beverage is then dispensed through the dispensing valve nozzle.

The reliability and consistency of any given beverage dispenser depends in part on an adequate and uniform incoming water flow and water pressure. For example, an inconsistent water flow or water pressure leading to the beverage dispenser can easily cause the internal water pump to fail. Such a failure generally requires the entire beverage dispenser to be taken out of service for repair. Further, even if the water pump does not fail, an inconsistent water flow or water pressure may lead to the beverage dispenser providing an inconsistent beverage in that the proportions of water and syrup may be altered from the norm. Such an inconsistent beverage may not taste the same to a consumer and leave that consumer unsatisfied.

Another problem caused by an inconsistent water flow or water pressure leading to the beverage dispenser is the possibility of back flow within the system. The incoming water line is generally made out of copper tubing. The elements of the beverage dispenser from the carbonator onward, however, are generally made out of stainless steel or similar types of non-corrosive or non-reactive materials. Stainless steel is used because of the tendency of copper to react with the carbon dioxide within the soda water. Any back flow pressure in the system may cause the soda water to travel out of the carbonator back towards the copper tubing. Such a back flow generally also requires the entire beverage dispenser to be taken out of service so as to inspect or replace the copper lines. To date, this potential problem has been addressed with the use of a number of reduced pressure zone valve or a double vent check valve. These valves generally eliminate or at least reduce the possibility of back flow out of the carbonator. These back flow preventors, however, can be somewhat expensive and may not be entirely reliable.

What is needed therefore, is a means for providing a reliable and consistent water flow and water pressure to a conventional beverage dispenser. Such a constant water flow and water pressure should prevent pump failure and also should prevent the possible back flow of soda water. This water flow and water pressure, however, must be provided in a safe and relatively inexpensive beverage dispensing system.

SUMMARY OF THE INVENTION

The present invention thus provides a water system for a beverage dispenser connected to a conventional water source. The water system includes a water tank with a given volume of water and a given volume of air. The water tank is connected to the conventional water source. A pump is connected to water tank so as to provide the water to the beverage dispenser.

Specific embodiments of the present invention include a stainless steel or plastic water tank. The volume of the tank may depend upon the size, number, and volume of the overall beverage dispenser system. Specifically, if the beverage dispenser provides an average of about eight (8), twenty-four (24) ounce servings over a ten (10) minute period at a desired temperature, the tank may have a volume of about two (2) to about five (5) gallons or more. The volume of air may be about ten (10) to about fifteen (15) percent of the water tank. The volume of water may be at atmospheric pressure.

The water system may further include an incoming water line connecting the water tank to the conventional water source. The incoming water line may be copper, stainless steel, or other types of substantially non-corrosive materials. The incoming water line may have a control valve thereon so as to open and close the line. The water tank may have a float control device in communication with the control valve, such that the float control device controls the control valve on the incoming water line. The float control device may include a switch and a float. The switch may be a magnetic sensor and the float may be an expanded polystyrene with a magnet positioned therein. The float control device opens the control valve on the incoming water line as the water level in the water tank drops.

The water system may further include an outgoing water line and a water relief line connecting the tank and the pump. More than one pump may be used. The pump may be a positive displacement pump such as a diaphragm vane pump or similar devices. The pump may be a variable speed pump with a flow rate of about two (2) to about six (6) gallons per minute. The water system may further include a dispenser line connecting the pump and the beverage dispenser. The dispenser line may have a pressure switch positioned therein so as to control the pump. The pressure switch may be a pressure transducer. The dispenser line may have a length of up to about 150 feet. The dispenser line may have an adjustable relief valve positioned thereon. The adjustable relief valve may include a return line in communication with the water tank.

A further embodiment of the present invention provides for a beverage dispenser in communication with a conventional water source. The beverage dispenser includes a water tank in communication with the conventional water source. The beverage dispenser also includes a pump in communication with the water tank and a water circuit in communication with the pump. The water from the conventional water source flows into the tank and through the pump to the water circuit. The water circuit may include a means for cooling the water flowing therein. These means may include a cold plate or a number of water cooling coils. The water circuit also may include a soda water circuit, a plain water circuit, and a number of beverage dispensing valves. The plain water circuit may be copper or stainless steel. The soda water circuit may be stainless steel. The soda water circuit may include a carbonator unit.

The method of the present invention provides water to a beverage dispenser from a conventional water source. The method includes the steps of filling a water tank with water from the conventional water source, pumping a first predetermined volume of the water by a pump to the beverage dispenser so as to provide a beverage, and then refilling the water tank with a second predetermined volume of water from the conventional water source such that the pump always has an available volume of the water regardless of the nature of the water source.

Other objects, features, and advantages of the present invention will become apparent upon review of the following detailed description of the preferred embodiments of the invention, when taken in conjunction with the drawings and the appended claims.

DETAILED DESCRIPTION OF THE INVENTION

Figure 1:
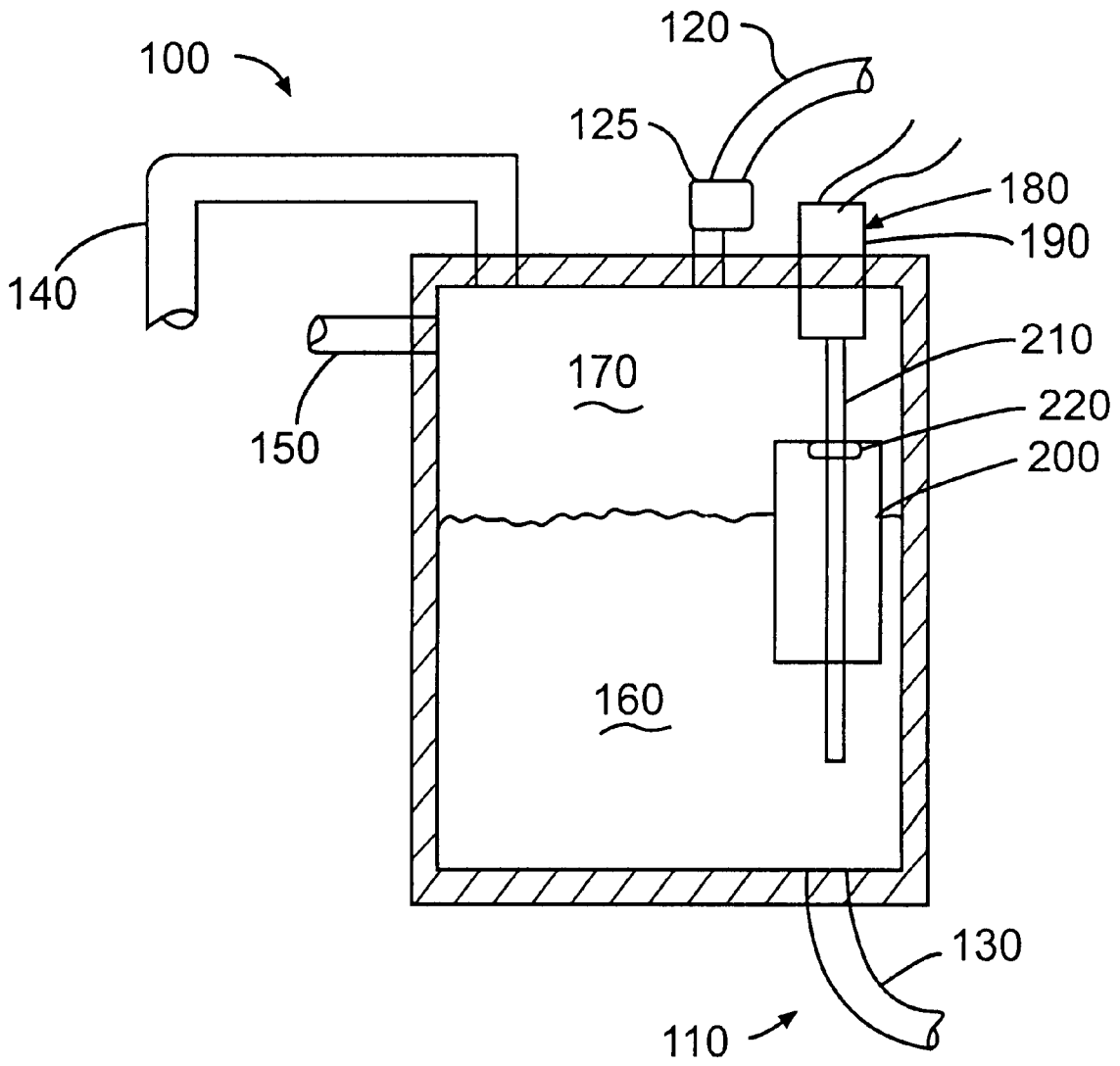
FIG. 1 is a side cross-sectional view of the water tank of the present invention.

Referring now in more detail to the drawings, in which like numerals refer to like elements throughout the several views, FIG. 1 shows a water tank 100 of the present invention. The tank 100 may be of any conventional shape used to hold a given volume of water. The tank 100 may be open-ended or enclosed. The tank 100 is preferably made from stainless steel, plastic, or other types of substantially non-corrosive materials. The size of the tank 100 depends upon the size, number, and volume of the overall beverage dispenser system. The tank 100 will generally range in size from about two (2) gallons to about five (5) gallons or more. For example, a tank 100 of about two (2) gallons in size may be used with a beverage dispenser having about six (6) dispensing nozzles to produce an average of about eight (8), twenty-four (24) ounce servings over about a ten (10) minute period at the desired temperature.

The tank 100 may have a number of fluid lines or conduits 110 attached thereto. The size or diameter of the conduits 110 also depends upon the size, number, and volume of the overall beverage dispenser system. In general, these conduits 110 may be about ⅜ inches or larger in inside diameter. Because the conduits 110 at this point do not come in contact with the carbon dioxide of the soda water, some or all of the conduits 110 may be made out of copper. Stainless steel, plastic, or other types of substantially non-corrosive materials also may be used.

The conduits 110 generally include an incoming water line 120. The incoming water line 120 is connected to a source of tap water or other conventional types of water sources. The incoming water line 120 may have a control valve 125 thereon. The control valve 125 opens and closes the incoming water line 120 on demand. The control valve 125 may be any type of conventional mechanical or electrical valve, such as a solenoid valve or other types of controllable valves. The tank 100 may further include an outgoing water line 130 and a water relief line 140. The outgoing water line 130 and the water relief line 140 are connected to the remaining tank and water pump system components as described in more detail below. Finally, the tank 100 may have an overflow drain line 150. The overflow drain line 150 may be connected to a conventional drain or other type of outgoing water system.

Positioned within the tank 150 is a given volume of water 160 and a given volume of an air space 170. The air space 170 may be about ten (10) to about fifteen (15) percent of the volume of the entire water tank 100. The air space 170 ensures that the water 160 within the tank 100 remains constantly and consistently at atmospheric pressure. The water 160 within the water tank 100 should not be pressurized beyond atmospheric pressure.

Also positioned within the tank 100 is a float control device 180. The float control device 180 controls the operation of the incoming water line 120 and the control valve 125. The float control device 180 may be any conventional type of mechanical or electrical device. The float control device 180 may be similar to those used in conventional carbonator tanks. The float control device 180 preferably includes a switch 190 and a float 200. The switch 190 may be a magnetic sensor or any type of conventional mechanism that breaks or creates an electrical circuit when activated. A conventional contact switch also may be used. The float 200 may be any type of conventional buoyant material such as an expanded polystyrene. The float 200 may be positioned near the switch 190 along a bar 210. The bar 210 may be any type of elongated rod or may be made from a flexible material such that the float 200 may be inserted thereon. The float 200 also may include a magnet 220 positioned therein. The magnet 220 may be any type of conventional magnetic or magnetizable metal material. The float 200 rises and falls with the level of the water 160 within the tank 100.

The switch 190 is activated as the magnet 220 within the float 200 moves up and down with the changing level of the water 160 within the tank 100. As the level of the water 160 declines, the float 200 moves away from the switch 190 such that the switch 190 activates the control valve 125 on the incoming water line 120. The control valve 125 and the water line 120 remain open until the level of the water 160 within the tank 100 rises and again brings the float 200 in contact with or near to the switch 190. The switch 190 then closes the control valve 125 on the incoming water line 120. The control valve 125 and the water line 120 remain closed until the level of the water 160 within the tank 100 drops.

Figure 2:
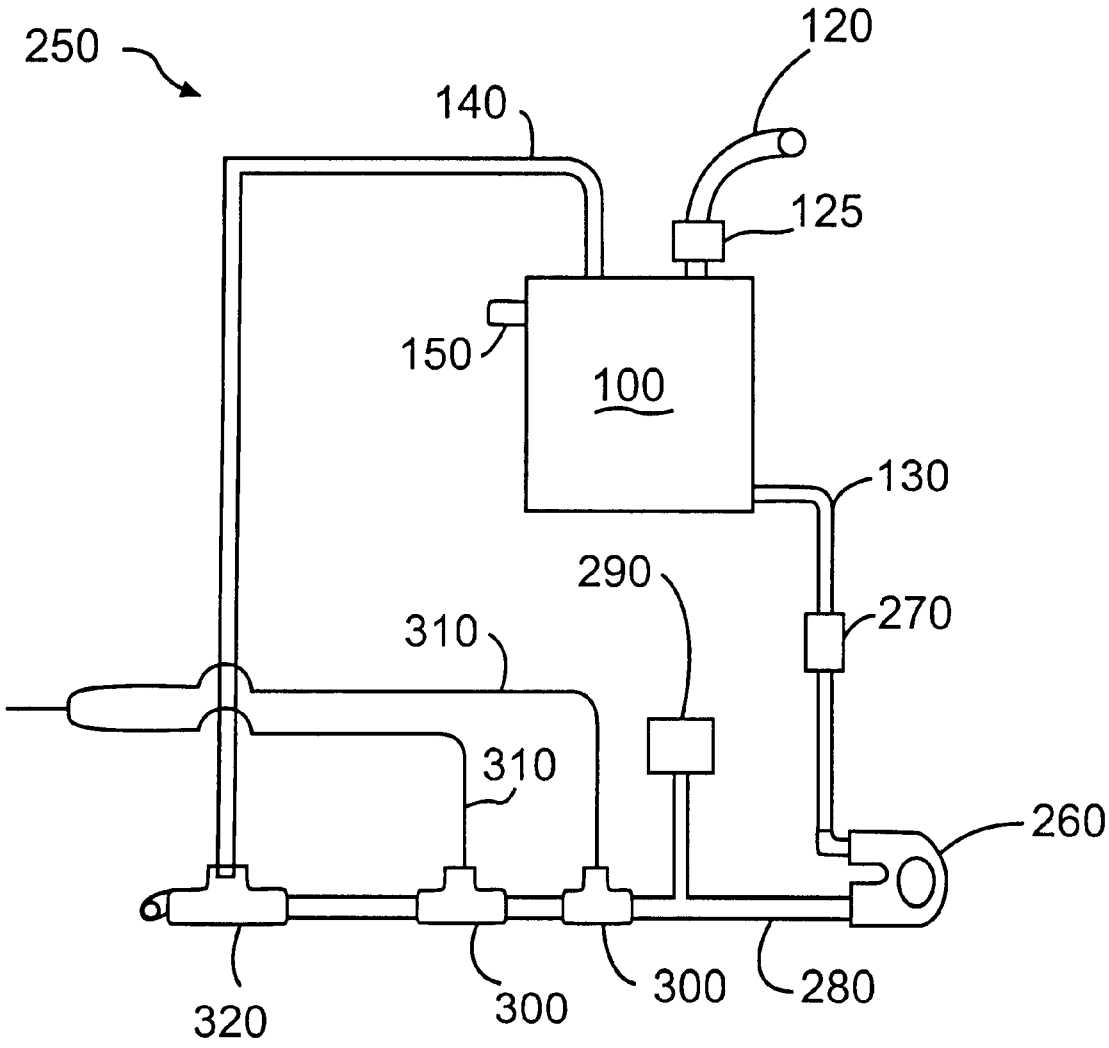
FIG. 2 is a schematic view the water tank and the water pump system of the present invention.

FIG. 2 shows a tank and pump system 250 of the present invention. The tank and pump system 250 includes the water tank 100 as described above as well as a pump 260. The pump 260 may be any type of conventional device. A preferred pump 260 is a positive displacement pump. For example, a multi-piston diaphragm vane pump may be used.

A preferred vane pump is manufactured by SHURflo Manufacturing of Santa Ana, Calif. Other types of conventional pumps may be used, such as a centrifugal pump or a similar types of pumps. More than one pump may be used. The speed of the pump 260 is preferably proportional to the flow rate therethrough. The pump 260 may have a flow rate of about two (2) to six (6) gallons per minute depending upon the size, number, and volume of the overall beverage dispenser system The pump 260 may be capable of many different flow rates.

The pump 260 is connected to the water tank 100 via the outgoing water line 130. A conventional check valve 270 may be positioned on the outgoing water line 130 between the water tank 100 and the pump 260. The check valve 270 may be of conventional design. The check valve 270 may be used to halt the fluid flow through the outgoing water line 130 if needed. The outgoing water line 130 may have an inside diameter of about 3/8 inches or more.

After passing through the pump 260, the water 160 flows through a pump line 280. The pump line 280 also may have an inside diameter of about ⅜ inches or more. A pressure switch 290 may be positioned on the pump line 280. The pressure switch 290 is in communication with the pump 260. The pressure switch 290 monitors the water pressure within the pump line 280 so as to control the pump 260. When the pressure within the pump line 280 drops, the pump 260 is turned on to maintain the desired pressure. The pressure switch 290 may be of a conventional mechanical or electrical design. Alternatively, the pressure switch 290 may be a conventional pressure transducer The pressure transducer not only turns the pump 260 on and off, but also varies the speed of the pump 260 so as to maintain the desired pressure.

The pump line 280 may be connected to one or more T-valves 300. The T-valves 300 may be conventional multi-directional valves. Each T-valve 300 leads to a cooling line 310 connected to the cooling system of the beverage dispenser. The T-valves 300 and the cooling lines 310 may be made out of copper, stainless steel, or other types of substantially non-corrosive materials. The number of T-valve 300 used depends upon the size, number, and volume of the overall beverage dispenser system. The cooling lines 310 may have an inside diameter of about ⅜ inches or more.

The pump line 280 also may have an adjustable relief valve 320 positioned thereon downstream of the T-valves 300. The adjustable relief valve 320 is connected to both the pump line 280 and the water relief line 140. Any water 160 that does not travel through one of the T-valves 300 may be routed through the water relief line 140 back to the water tank 100. The adjustable relief valve 320 may be a spring-balanced piston that opens and closes to maintain a constant pressure output. Any conventional type of mechanical or electrical device may be used. Further, the relief valve 320 may not be needed if a pressure transducer is used as the pressure switch 290.

The tank and pump system 250 may be distinct from the remainder of the beverage dispenser system. In fact, the tank and pump system 250 may be up to about 150 feet away from the remainder of the beverage dispenser depending upon the size of the pump 260 and the overall beverage dispenser system. The tank and pump system 250 therefore may be set upon in the "backroom" while the beverage dispenser is in a distinct location to serve the consumer.

Figure 3:
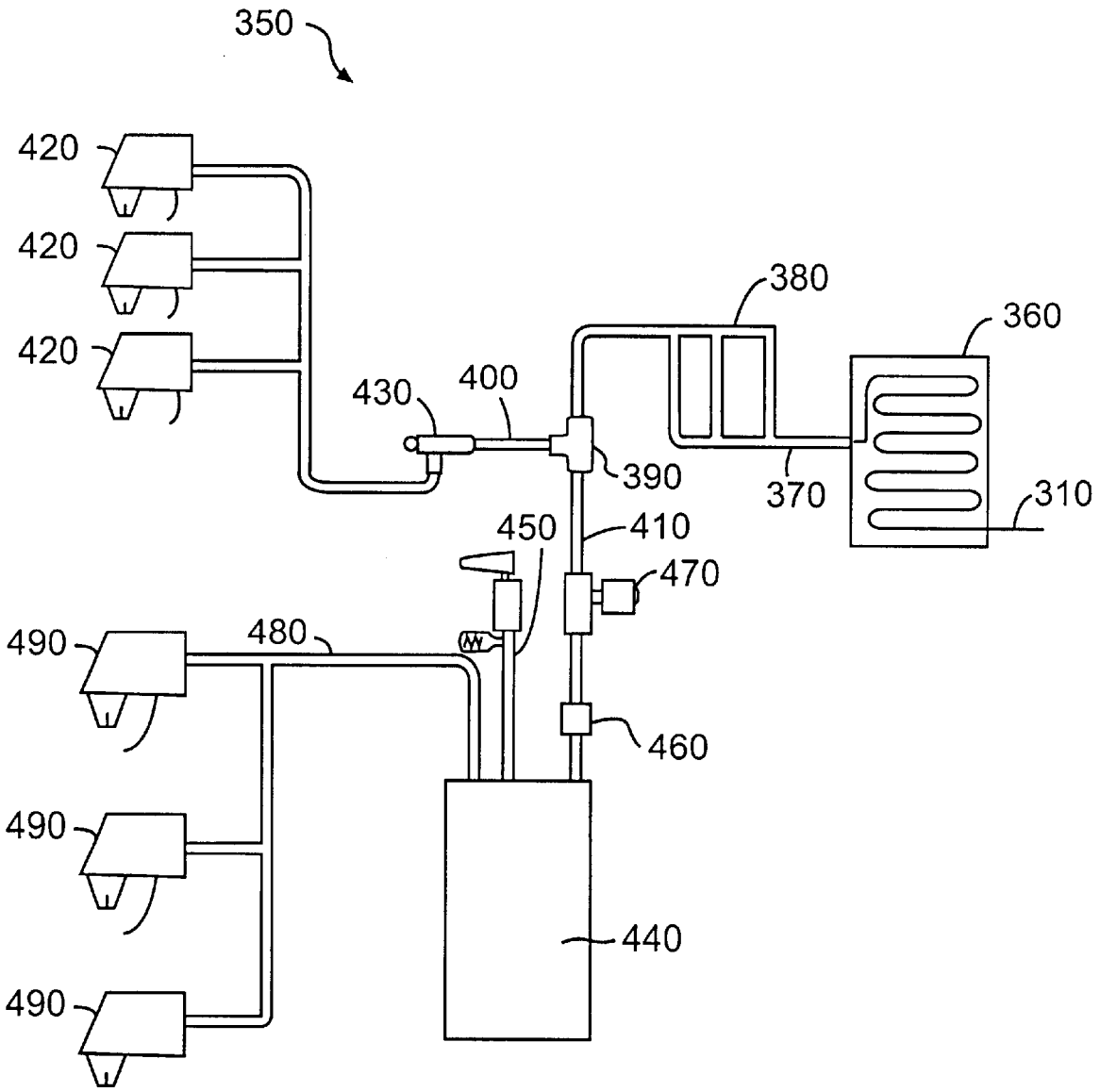
FIG. 3 is a schematic view of beverage dispenser of the present invention downstream of the water tank and the water pump system.

FIG. 3 shows a beverage dispenser 350 for use with the present invention. The beverage dispenser 350 is largely of conventional design. The beverage dispenser 350 includes a syrup and water cooling system such as a cold plate 360. The cold plate 360 is also of conventional design. The cold plate 360 is generally positioned beneath an ice bath for heat transfer between the water flowing therethrough and the ice of the ice bath as is known to those skilled in the art. Alternatively, a series of water cooling coils could be used in place of the cold plate 360. The cold plate 360 chills the water 160 flowing from the tank and pump system 250 via the cooling lines 310.

The cold plate 360 is connected to an outflow line 370. The outflow line 370 may lead to a manifold 380 depending upon the configuration of the beverage dispenser 350 as a whole. The outflow line 370 may be about ⅜ inches or more in inside diameter and may be made from copper, stainless steel, or other types of substantially non-corrosive materials. The outflow line 370 then leads to an outflow line T-valve 390. The T-valve 390 is also a conventional multi-directional valve. One end of the T-valve 390 is connected to a plain water line 400 while the other end of the T-valve 390 is connected to a soda water line 410.

The plain water line 400 leads to one or more plain water dispensing valves 420. The plain water line 400 may be made out of copper, stainless steel, or other types of substantially non-corrosive materials. The plain water dispensing valves 420 may mix the plain water with a syrup or a concentrate as is known to those skilled in the art. Alternatively, the dispensing valves 420 may dispense the plain water directly. The dispensing valves 420 may be of conventional design. An adjustable relief valve 430 may be positioned on the plain water line 400 before the plain water dispensing valves 420. As described above, the adjustable relief valve 430 ensures a constant pressure output.

The soda water line 410 may lead to a conventional carbonator unit 440. Because the soda water line 410 is connected to the carbonator unit 440, the soda water line may be made out of stainless steel or other types of substantially non-corrosive and non-reactive materials. The carbonator unit 440 may be of conventional design. The carbonator unit 440 mixes the water 160 from the soda water line 410 with carbon dioxide gas from a carbon dioxide line 450 so as to produce soda water. The carbonator tank 440 also may be chilled. Positioned on the soda water line 410 may be a check valve 460 and a carbonator solenoid valve 470. The check valve 460 may be of conventional design. The check valve 460 may stop the flow of water through the soda water line 410 if needed. The carbonator solenoid valve 470 controls the input and the operation of the carbonator tank 440 as is well known to those skilled in the art.

The soda water from the carbonator tank 440 then exits via a carbonated dispensing valve line 480 to the carbonated dispensing valves 490. The carbonated dispensing valve line 480 may be made out of stainless steel or other types of substantially non-corrosive and non-reactive materials. The soda water mixes with a concentrate or a syrup within the carbonating dispensing valves 490 as is well known to those skilled in the art so as to produce a beverage such as a carbonated soft drink. Alternatively, the dispensing valves 490 may dispense the soda water directly. The carbonated dispensing valves 490 may be of conventional design.

In use, the water tank and pump system 250 is activated whenever a beverage dispensing valve 420, 490 is activated. The pressure switch 290 determines a drop in pressure within the pump line 280. The pressure switch 280 therefore turns the pump 260 on or changes the speed of the pump 260 depending upon the demand on the beverage dispenser 350 as a whole. As the pump 260 is operated, the water level within the water tank 100 drops. The float valve 180 detects this drop and opens up the control valve 125 on the incoming water line 120. The incoming water line 120 remains open until the water tank 100 is again full. Because of the use of the water tank 100, the beverage dispenser 350 in general and the pump 260 in specific does not depend upon the incoming water line 120 to provide a constant water flow or constant water pressure.

The combination of the water tank 100 and the pump 260 therefore provide a consistent and constant flow of water to the beverage dispenser 350. Specifically, the tank and pump system 250 provides a constant water source at a constant water pressure at all times for the beverage dispenser 350. The volume of the water 160 and the airspace 170 within the water tank 100 ensure that the pump 260 has a constant water supply at a constant atmospheric pressure. This constant pressure reduces the possibility of pump failure and also largely eliminates the danger of back flow. Irregularities in the incoming water flow or water pressure, if any, are compensated by the water 160 already present within the tank 100. The use of the float valve 180 and the control valve 125 on the incoming water line valve 120 ensure that the tank 100 remains sufficiently filled with water 160 so as to accommodate the dispensing valves 420, 490.

The pump 260 also provides a sufficient amount of water to the dispensing valves 420, 490 in a simplified system. The speed of the pump 260 may change as the function of the demanded flow. The single pump 260 can therefore accommodate both the plain water dispensing valve 420 and the carbonated water dispensing valve 490.

It should be apparent that the foregoing relates only to the preferred embodiments of the present invention and that numerous changes and modifications may be made herein without departing from the spirit and scope of the invention as defined by the following claims.

We claim:

1. In combination, a water system and a beverage dispenser connected to a pressurized water source, the pressure of which varies, comprising:

a water tank;

said water tank comprising a volume of water and a volume of air;

said volume of water being at atmospheric pressure;

said water tank being connected downstream to said pressurized water source; and a pump connected downstream to said water tank, said pump providing water to said beverage dispenser at a substantially constant pressure.

2. The water system of claim 1, wherein said tank comprises stainless steel or plastic.

3. The water system of claim 1, wherein said tank comprises about two (2) gallons to about five (5) gallons or more.

4. The water system of claim 3, wherein said beverage dispenser comprises a plurality of dispensing nozzles for providing an average of about eight (8) twenty-four (24) ounce servings over a ten (10) minute period at a desired temperature and wherein said tank comprises about two (2) gallons.

5. The water system of claim 1, further comprising an incoming water line connecting said water tank to said conventional water source.

6. The water system of claim 5, wherein said incoming water line comprises copper, stainless steel, or other types of substantially non-corrosive materials.

7. The water system of claim 5, wherein said incoming water line comprises a control valve thereon so as to open and close said incoming water line.

8. The water system of claim 7, wherein said water tank comprises a float control device in communication with said control valve, such that said float control device controls said control valve on said incoming water line.

9. The water system of claim 8, wherein said float control device comprises a switch and a float.

10. The water system of claim 9, wherein said switch comprises a magnetic sensor.

11. The water system of claim 9, wherein said float comprises an expanded polystyrene and a magnet positioned therein.

12. The water system of claim 1, further comprising an outgoing water line connecting said tank and said pump.

13. The water system of claim 1, wherein said volume of air comprises about ten (10) to fifteen (15) percent of said water tank.

14. The water system of claim 1, wherein said pump comprises a positive displacement pump.

15. The water system of claim 14, wherein said pump comprises a diaphragm vane pump.

16. The water system of claim 1, wherein said pump comprises a flow rate of about two (2) to about six (6) gallons per minute.

17. The water system of claim 1, wherein said pump comprises variable speed pump.

18. The water system of claim 1, further comprising a dispenser line connecting said pump and said beverage dispenser.

19. The water system of claim 18, wherein said dispenser line comprises a pressure switch positioned therein so as to control said pump.

20. The water system of claim 18, wherein said pressure switch comprises a pressure transducer.

21. The water system of claim 18, wherein said dispenser line comprises a length up to about 150 feet.

22. The water system of claim 18, wherein said dispenser line comprises an adjustable relief valve positioned thereon.

23. The water system of claim 22, further comprising a return line such that said adjustable relief valve is in communication with said water tank.

24. In combination, a water system and a beverage dispenser in communication with a pressurized water source, comprising:

a water tank;

said water tank comprising a volume of water and a volume of air;

said volume of water being at atmospheric pressure;

said water tank being connected downstream from and in communication with said pressurized water source;

a pump downstream from and in communication with said water tank; and a water circuit downstream from and in communication with said pump, said water circuit including at least one of means for cooling water, a soda water circuit, a plain water circuit, and beverage dispensing valves, wherein water from said pressurized water source flows into said tank and through said pump to said water circuit.

25. The beverage dispenser of claim 24, wherein said water circuit comprises a means for cooling the water flowing within said water circuit.

26. The beverage dispenser of claim 24, wherein said water circuit comprises a soda water circuit and a plain water circuit.

27. The beverage dispenser of claim 26, wherein said plain water circuit comprises copper or stainless steel.

28. The beverage dispenser of claim 26, wherein said soda water circuit comprises a carbonator unit.

29. The beverage dispenser of claim 26, wherein said soda water circuit comprises stainless steel.

30. The beverage dispenser of claim 24, wherein said water circuit comprises a plurality of beverage dispensing valves.

31. A method of providing water to a beverage dispenser from a pressurized water source, comprising:

filling a water tank with water from a pressurized water source, the pressure of which may vary;

maintaining a predetermined volume of air space in the tank such that the volume is maintained at atmospheric pressure;

pumping a first predetermined volume of the water from the tank, through the pump and to the beverage dispenser at a substantially constant pressure so as to provide a beverage; and refilling the water tank with a second predetermined volume of water from the pressurized water source such that the pump has an available volume of said water at said atmospheric pressure.

* * * * *

UNITED STATES PATENT AND TRADEMARK OFFICE

CERTIFICATE OF CORRECTION

PATENT NO. : 6,273,295 B1
DATED : August 14, 2001
INVENTOR(S) : Daniel S. Quartarone et al.

It is certified that error appears in the above-identified patent and that said Letters Patent is hereby corrected as shown below:

Column 10, claim 31,
Line 2, after "through the pump", insert a comma.

Signed and Sealed this

Twenty-sixth Day of February, 2002

*Attest:*

*Attesting Officer*

JAMES E. ROGAN
*Director of the United States Patent and Trademark Office*